US007624792B2

(12) United States Patent
Wright et al.

(10) Patent No.: US 7,624,792 B2
(45) Date of Patent: Dec. 1, 2009

(54) SHEAR ACTIVATED SAFETY VALVE SYSTEM

(75) Inventors: Adam D. Wright, Dallas, TX (US); Vincent P. Zeller, Flower Mound, TX (US); Harold W. Nivens, Decatur, TX (US); Roger L. Schultz, Aubrey, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 408 days.

(21) Appl. No.: 11/253,766

(22) Filed: Oct. 19, 2005

(65) Prior Publication Data

US 2007/0084607 A1 Apr. 19, 2007

(51) Int. Cl.
*E21B 34/16* (2006.01)
*E21B 29/04* (2006.01)

(52) U.S. Cl. ..... 166/54.5; 166/338; 166/373; 166/332.8; 166/319; 166/363; 166/321; 137/68.11

(58) Field of Classification Search ..... 166/338, 166/373, 374, 382, 54.5, 55, 55.1, 332.8, 166/332.3, 317, 386, 321, 364, 363, 319; 137/68.11

See application file for complete search history.

(56) References Cited

U.S. PATENT DOCUMENTS 3,860,066 A * 1/1975 Pearce et al. ..... 166/72
4,173,256 A 11/1979 Kilgore
4,223,736 A * 9/1980 Foster, Jr. ..... 166/386
4,522,370 A * 6/1985 Noack et al. ..... 251/63.5
5,101,904 A 4/1992 Gilbert
6,269,874 B1 8/2001 Rawson et al.
2003/0168219 A1 9/2003 Sloan
2004/0003926 A1 1/2004 Nivens et al.
2005/0126789 A1 6/2005 Nivens et al.

FOREIGN PATENT DOCUMENTS

GB 2427422 12/2006

OTHER PUBLICATIONS

Search Report for United Kingdom application No. GB0620525.6.

* cited by examiner

*Primary Examiner*—David J Bagnell
*Assistant Examiner*—Brad Harcourt
(74) *Attorney, Agent, or Firm*—Marlin R. Smith

(57) ABSTRACT

A safety valve system includes a safety valve having an actuator and a line connected to the actuator. The safety valve is operable by opening the line in the well, with the line being free of any connection to a surface control system. Another safety valve system includes multiple safety valves. An actuator of each safety valve is connected to an actuator of another safety valve via a line. A biasing force in each of the actuators is operative to close the respective one of the safety valves in response to opening of the line. The biasing force is produced at least in part by hydrostatic pressure in a well.

7 Claims, 5 Drawing Sheets

SHEAR ACTIVATED SAFETY VALVE SYSTEM

BACKGROUND

The present invention relates generally to operations performed and equipment utilized in conjunction with a subterranean well and, in an embodiment described herein, more particularly provides a shear activated safety valve system.

In offshore well testing operations, it is common practice to use two safety valves connected to each other via a shear joint and ramlock sub. The shear joint is typically positioned in the shear rams, and the ramlock sub is typically positioned in the sealing rams of a subsea wellhead. The sealing rams seal about the ramlock sub.

In the event of an emergency, the shear rams can shear the shear joint, allowing an upper portion of the test string to be quickly retrieved either before or after the emergency has passed, and leaving a lower portion of the test string in the well below the wellhead. The lower safety valve prevents fluid from escaping from the well via the lower portion of the test string.

In the past, the safety valves have been generally operated using a control line or umbilical extending to a platform or rig at the surface of the water. It will be appreciated by those skilled in the art that it is quite expensive and time-consuming to install and pressure test this control line.

Safety valves have been developed which use a highly pressurized nitrogen chamber to produce a biasing force in an actuator of the valve. However, it will be appreciated that safety concerns need to be addressed when charging and handling such highly pressurized chambers at the surface.

Therefore, it may be seen that improvements are needed in the art of safety valve systems. The present invention provides such improvements. These improvements are not necessarily limited to the issues raised by the foregoing background information.

SUMMARY

In carrying out the principles of the present invention, a safety valve system is provided which solves at least one problem in the art. One example is described below in which hydrostatic pressure is used to produce biasing forces in actuator(s) of one or more safety valves. Another example is described below in which the actuator is connected to a line containing fluid pressurized above hydrostatic pressure, so that opening of the line permits the actuator to close the safety valve.

In one aspect of the invention, a safety valve system for use in a subterranean well includes at least one safety valve having an actuator. A line is connected to the actuator. The safety valve is operable by opening the line in the well, with the line being free of any connection to a surface control system.

In another aspect of the invention, a safety valve system is provided which includes multiple safety valves. An actuator of each safety valve is connected to an actuator of another safety valve via a line. A biasing force in each of the actuators is operative to close the respective one of the safety valves in response to opening of the line. The biasing force is produced at least in part by hydrostatic pressure in a well.

In yet another aspect of the invention, a method of operating a safety valve system in a subterranean well is provided. The method includes the steps of: installing in the well at least one safety valve having an actuator; and the installing step including connecting a line to the actuator without connecting the line to a surface control system.

In a further aspect of the invention, a method of operating a safety valve system is provided. The method includes the steps of: connecting actuators of multiple safety valves to each other with a line, and installing the safety valves in a well. Hydrostatic pressure in the well produces a biasing force in each of the actuators, so that opening of the line in the well is operative to permit the biasing forces to close the respective safety valves.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
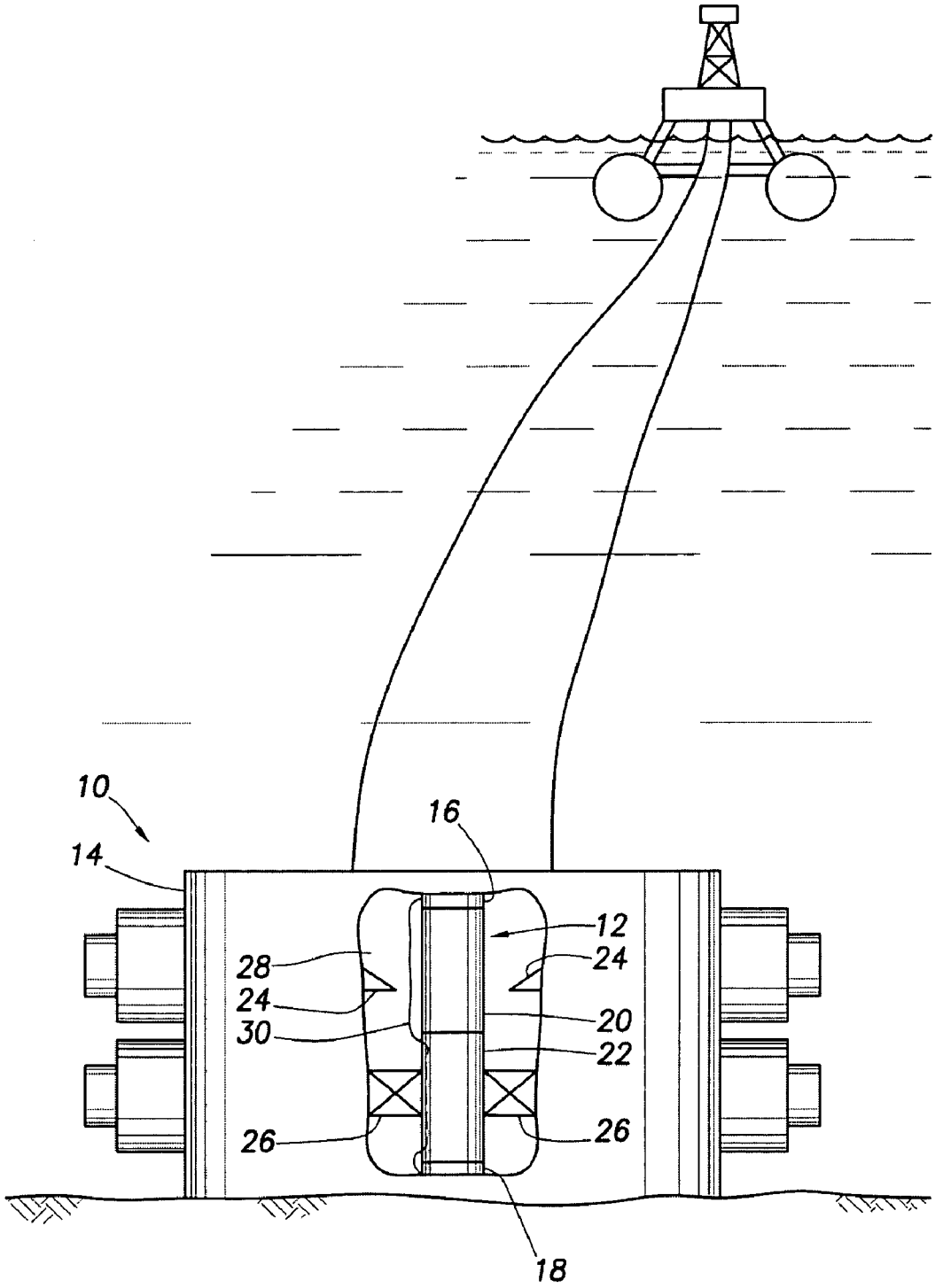
FIG. 1 is a schematic elevational view of a shear activated safety valve system embodying principles of the present invention.

Representatively illustrated in FIG. 1 is a safety valve system 10 which embodies principles of the present invention. The system 10 is depicted in FIG. 1 as being used in conjunction with a formation testing operation on a subsea well, but it should be clearly understood that the invention is not limited to any of the details of this example. For example, the invention could be used in other types of operations (such as completion or intervention operations, etc.) and on other types of wells.

The system 10 includes a test string 12 installed in a subsea wellhead 14. The test string 12 includes an upper safety valve 16, a lower safety valve 18, a shear joint 20 and a ramlock 22. The safety valves 16, 18 are used to close off the test string 12 in the event of an emergency (such as an eminent safety hazard).

The shear joint 20 is positioned within shear rams 24 of the wellhead 14. The shear rams 24 will close and shear the shear joint 20 if it is necessary to sever the test string 12, for example, if the upper portion of the test string must be retrieved as quickly as possible in an emergency.

The ramlock 22 is positioned within sealing rams 26 of the wellhead 14. The sealing rams 26 seal against an outer surface of the ramlock 22, providing pressure isolation in an annulus 28 surrounding the test string 12. Note that in some embodiments of the invention a ramlock may not be used.

A line 30 is connected between the upper safety valve 16 and the lower safety valve 18. As described more fully below, the line 30 provides fluid communication between actuators of the safety valves 16, 18.

In addition, when the shear rams 24 are operated to sever the shear joint 20, the line 30 is also severed or otherwise opened, thereby causing both of the safety valves 16, 18 to close. By closing both of the safety valves 16, 18, the test string 12 is isolated above and below the shear rams 24. With the sealing rams 26 also sealed against the ramlock 22, the well below the wellhead 14 is thereby completely isolated in an emergency.

Note that the line 30 is depicted in FIG. 1 as being external to the shear joint 20 and internal to the ramlock 22. By positioning the line 30 external to the shear joint 20 and constructing the line of a collapse resistant rubber composition in this area, the line is more reliably severed and will remain open after being severed.

By positioning the line 30 internal to the ramlock 22 (e.g., machined or otherwise formed in a sidewall of the tubular ramlock, integrally formed with the ramlock, etc.), the sealing rams 26 can more reliably seal against the exterior of the ramlock. However, it should be clearly understood that it is not necessary for the line 30 to be positioned as depicted in FIG. 1, and the line can be made of any type of material, or otherwise positioned, in keeping with the principles of the invention.

Figure 2:
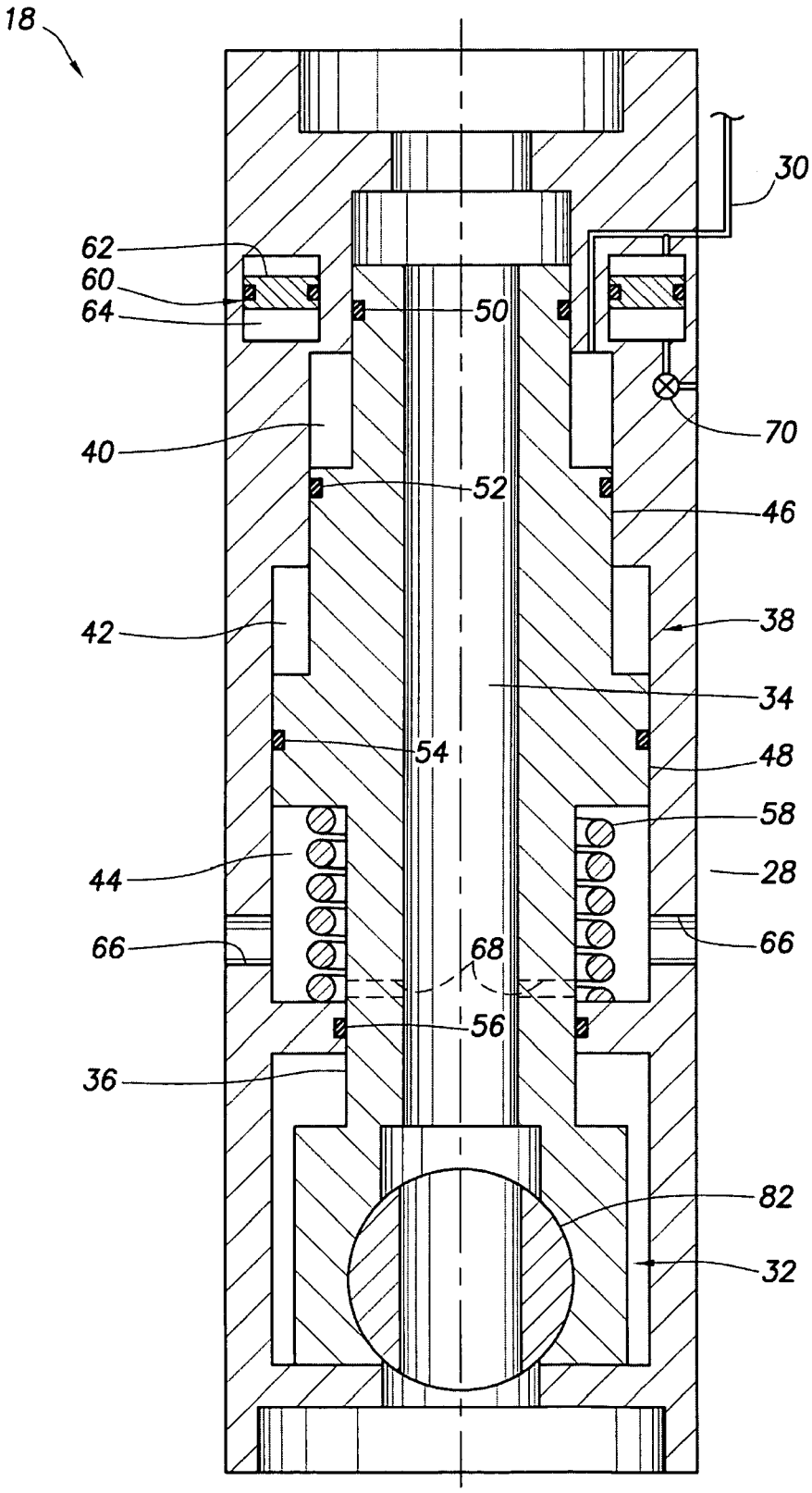
FIG. 2 is an enlarged scale schematic cross-sectional view of a safety valve usable in the system of FIG. 1.

Referring additionally now to FIG. 2, an enlarged scale schematic cross-sectional view of the lower safety valve 18 is representatively illustrated, apart from the remainder of the test string 12. The upper safety valve 16 is not shown in cross-section, but it is similar in most respects to the lower safety valve 18.

In FIG. 2 it may be seen that the safety valve 18 includes a ball closure mechanism 32. Preferably, this mechanism 32 is of the type which includes a cutting device 82 (e.g., a ball of the closure mechanism) capable of shearing obstructions (such as coiled tubing, wireline, etc.—see obstruction 92 shown in FIGS. 4 & 5) in an internal flow passage 34 of the safety valve 18 when the mechanism is closed to seal off the passage. However, other types of closure mechanisms (such as those using flappers, sliding closures, etc.) could be used in keeping with the principles of the invention.

The closure mechanism 32 is operated by axial displacement of a generally tubular mandrel 36 of the safety valve 18. In this example, upward displacement of the mandrel 36 is used to shift the closure mechanism 32 to a closed position, and downward displacement of the mandrel is used to shift the closure mechanism to an open position. Other types of displacements (such as rotational displacement, etc.) and combinations of displacements may be used to operate a closure mechanism in keeping with the principles of the invention.

The safety valve 18 includes an actuator 38 which is used to displace the mandrel 36. The actuator 38 includes internal chambers 40, 42, 44, pistons 46, 48 and seals 50, 52, 54, 56 for applying biasing forces to the mandrel 36 due to pressure differentials between the chambers.

The actuator 38 also includes a compression spring 58 for upwardly biasing the mandrel 36 (i.e., in a direction to close the closure mechanism 32), so that the safety valve 18 will "fail closed." That is, in the absence of pressure differentials in the chambers 40, 42, 44 to properly operate the safety valve 18 (such as, in the event of failure of one or more of the seals 50, 52, 54, 56), the spring 58 will bias the mandrel 36 upward to close the closure mechanism 32.

The upper chamber 40 is connected to the line 30. In use, a similar chamber in the upper safety valve 16 would also be connected to the line 30. In this manner, the actuators 38 of the safety valves 16, 18 are connected and in fluid communication via the line 30.

Preferably, the line 30 and chambers 40 of the upper and lower safety valves 16, 18 are filled with liquid, such as hydraulic fluid. Due to thermal expansion and contraction of such liquids and a desire to prevent such expansion and contraction from inadvertently causing the mandrel 36 to displace and operate the closure mechanism 32, the actuator 38 can include an accumulator 60 connected to the line 30, for example, with a floating piston 62 and pressurized gas chamber 64. The accumulator 60 may also be used to compensate for thermal expansion/contraction of the line 30 and components of the safety valves 16, 18 (such as chambers 40, 42, etc.).

Figure 3:
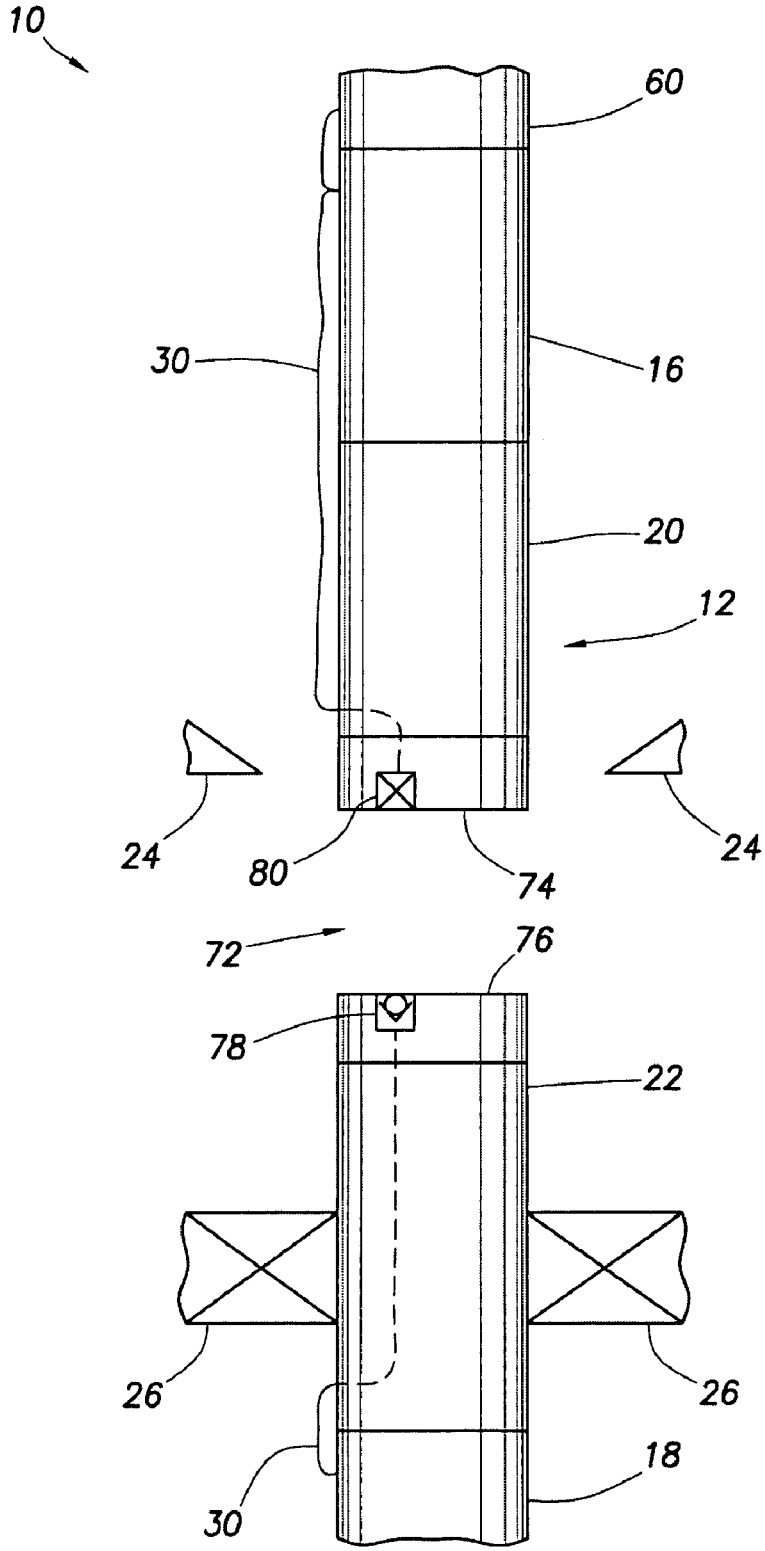
FIG. 3 is a schematic elevational view of an alternate construction of the shear activated safety valve system.

The accumulator 60 is depicted in FIG. 2 as being an integral part of the safety valve 18, but the accumulator could instead be a separate element of the test string 12 (as illustrated in FIG. 3). Furthermore, it should be understood that the accumulator 60 is not necessary to compensate for thermal expansion or contraction of fluid in the line 30, or thermal expansion/contraction of the line and components of the safety valves 16, 18.

For example, a relatively compressible fluid, such as a silicone-based fluid, could be used in the line 30 and chambers 40 to provide compensation for thermal expansion and contraction, or another fluid with a relatively low coefficient of thermal expansion could be used, etc. In addition, the closure mechanism 32 could be designed so that relatively small displacements of the mandrel 36 due to expansion/contraction of the fluid in the line 30 and chamber 40 will not cause undesirable opening or closing of the closure mechanism.

The chamber 42 preferably contains air or an inert gas and has relatively low (for example, atmospheric) pressure therein when the safety valve 18 is installed. Of course, pressure in the chamber 42 will fluctuate somewhat with changing temperature in the well environment when the safety valve 18 is installed, and the pressure in the chamber will also change somewhat when the mandrel 36 is displaced (due to expansion and contraction of the chamber volume), but preferably the pressure in the chamber will remain substantially at a relatively low pressure. If desired, other pressures may be used in the chamber 42 in keeping with the principles of the invention.

The chamber 44 is preferably connected to the annulus 28 surrounding the safety valve 18 via openings 66. When the safety valve 18 is installed in the well, hydrostatic pressure in the annulus 28 can be used to bias the piston 48 upwardly.

Note that the chamber 44 could instead be connected to the flow passage 34 via optional openings 68, so that hydrostatic pressure in the passage could be used to bias the piston 48 upwardly. If the openings 68 are used, then the openings 66 would not be present in the safety valve 18.

As described above, hydrostatic pressure in the chamber 44 biases the piston 48 upwardly. Relatively low pressure in the chamber 42 biases the piston 48 downwardly, but since the hydrostatic pressure is far greater than the pressure in the chamber 42 when the safety valve 18 is installed, and since the piston area of the piston exposed to the chamber 44 is greater than the piston area of the piston exposed to the chamber 42, the net biasing force produced by this pressure differential across the piston 48 is directed upward.

In order to displace the mandrel 36 downward, the upward net biasing force produced by the pressure differential across the piston 48 and the upward biasing force exerted by the spring 58 is exceeded by a downwardly directed biasing force produced by pressure in the chamber 40 acting on a piston area of the piston 46 exposed to the chamber. Since the piston area of the piston 46 exposed to the chamber 40 is less than the piston area of the piston 48 exposed to the chamber 44, it will be readily appreciated by those skilled in the art that pressure in the chamber 40 will be greater than hydrostatic pressure in order to displace the mandrel 36 downward, or to maintain the mandrel in its downward position as depicted in FIG. 2.

In a preferred method of installing the safety valves 16, 18, the safety valves are assembled and interconnected in the test string 12 with the shear joint 20 and ramlock 22 therebetween. The actuators 38 of the safety valves 16, 18 are connected via the line 30.

The line 30 and chambers 40 of the actuators 38 are filled with fluid. At this point, the spring 58 will be maintaining the mandrel 36 in an upward position and the safety valves 16, 18 will thus be closed. If the accumulator 60 is used, a gas (such as nitrogen) may be used to pressurize the chamber 64, for example, via a filler valve 70.

The safety valves 16, 18 are preferably opened prior to completely installing the test string 12 in the well. The closure mechanisms 32 are opened by applying sufficient pressure to the line 30 to overcome the upward biasing force exerted by the springs 58 and thereby displace the mandrels 36 downward.

Once the mandrels 36 have been displaced downward a sufficient distance to open the closure mechanisms 32, additional pressure may be applied to the line 30 to somewhat compress the gas in the chamber 64, so that the piston 62 will be able to displace after installation to adequately compensate for thermal expansion/contraction of the fluid in the line 30 and chambers 40, and thermal expansion/contraction of the line and safety valves 16, 18.

The test string 12 is then installed as depicted in FIG. 1. As the test string 12 is lowered into the well, hydrostatic pressure in the annulus 28 about the safety valves 16, 18 increases. Of course, if the test string 12 is filled with fluid as it is installed, then hydrostatic pressure in the passage 34 will also increase as the test string is installed.

This hydrostatic pressure (from the annulus 28 or passage 34) is communicated to the chambers 44 and thereby applies an increasing upward biasing force to the mandrels 36 due to the pressure differential across the pistons 48 as described above. This increased upward biasing force is countered by increased pressure in the line 30 and chambers 40.

Fluid in the line 30 and chambers 40 is preferably a relatively incompressible fluid, so that as the upwardly biasing force due to the pressure differential across the pistons 48 increases, pressure in the line 30 and chambers 40 also increases, thereby preventing the volume of the chambers 40 from decreasing significantly, and thereby preventing the mandrels 36 from displacing upward significantly. As mentioned above, pressure in the line 30 and chambers 40 will be greater than hydrostatic pressure to maintain the mandrels 36 in their downwardly displaced positions and to maintain the closure mechanisms 32 in their open positions.

If it becomes necessary to close the safety valves 16, 18, the shear rams 24 will be closed, thereby severing the shear joint 20 and line 30, and thereby opening the line so that it communicates with the annulus 28. In this manner, the line 30 and chambers 40 are exposed to hydrostatic pressure and the fluid in the line and chambers can no longer maintain the mandrels 36 in their downwardly displaced position.

At this point, the upward biasing force produced by the pressure differential across the pistons 48 and the biasing force exerted by the springs 58 will displace the mandrels 36 upward, thereby closing the closure mechanisms 32. Upward displacement of the mandrels 36 is no longer prevented by the fluid in the chambers 40, since the chambers can have no greater than hydrostatic pressure therein (due to opening of the line 30 to the annulus 28). Hydrostatic pressure in the chambers 40 cannot prevent upward displacement of the mandrels 36, since the piston area of the piston 46 exposed to the chamber 40 is less than the piston area of the chamber 44 exposed to the piston 48. When the closure mechanisms 32 close, any obstruction (such as obstruction 92 shown in FIGS. 4 & 5) in the passage 34 will be severed by the cutting devices 82.

Note that other configurations of actuators could be used in the safety valves 16, 18 without departing from the principles of the invention. For example, the chambers 40, 42, 44 and pistons 46, 48 could be differently arranged, different numbers and types of chambers and pistons could be used, etc. Use of the spring 58 is not necessary, and other types of biasing devices (such as gas springs) could be used instead.

In a preferred embodiment, the upper safety valve 16 is constructed and installed so that it is inverted vertically (upside-down) as compared to the lower safety valve 18 as depicted in FIG. 2. In accordance with conventional "pump through" ball-type safety valve designs, this allows fluid to be circulated downward through the upper safety valve 16 after it has been closed, for example, to kill the well.

In one alternate configuration, the chambers 40, 42 could be reversed, so that the chamber 40 has relatively low pressure therein and the chamber 42 is connected to the line 30. Many other configurations are possible, and it should be clearly understood that the actuator 38 is described herein as merely one example of a wide variety of actuators that could be used in keeping with the principles of the invention.

In another alternate configuration of the system 10, only a single safety valve could be used. Thus, it is not necessary in keeping with the principles of the invention for multiple safety valves to be used. If only a single safety valve is used (for example, the lower safety valve 18), then a distal end of the line 30 could be closed off or connected to the separate accumulator 60 described below. The line 30 would still extend external to the shear joint 20, and would be severed when the shear rams 24 are operated, thereby causing the safety valve 18 to close.

Referring additionally now to FIG. 3, the system 10 is representatively and schematically illustrated in an alternate configuration which permits upper and lower portions of the test string 12 to be separated without actuating the shear rams 24 to sever the shear joint 20 and line 30. Note that in FIG. 3 various details of the well, including the wellhead 14, etc., are not shown for clarity.

In certain circumstances it may be desired to separate the upper portion of the test string 12 from the lower portion temporarily, for example, to accommodate a short term emergency or safety situation. Thus, in these circumstances it would be desirable to be able to reconnect the upper and lower portions of the test string 12 to permit continuation of the testing operation after the emergency or other safety situation has been dealt with.

In FIG. 3, the system 10 is depicted after the upper portion of the test string 12 has been disconnected from the lower portion of the test string using a latch assembly 72. The latch assembly 72 includes an upper latch 74 connected at a lower end of the shear joint 20, and a lower latch 76 connected at an upper end of the ramlock 22.

The upper and lower latches 74, 76 may be disconnected from and reconnected to each other in the well after the test string 12 has been installed. For example, the latches 74, 76 could be connected to each other via J-slots, ratchet mechanisms (such as a RATCH-LATCH™ ratchet mechanism available from Halliburton Energy Services, Inc. of Houston, Tex.) which permit one or more sequence of disconnecting and reconnecting.

Preferably, at least the lower safety valve 18 will close when the upper portion of the test string 12 is disconnected from the lower portion of the test string. For this purpose, the lower latch 76 is provided with a check valve 78 which permits fluid in the line 30 to bleed off when the latches 74, 76 are disconnected from each other.

When the latches 74, 76 are reconnected, the check valve 78 can be opened and maintained open by a prong, stinger or other device (not shown) on the upper latch, so that the line 30 is open for flow in both directions between the safety valves 16, 18. The upper latch 74 can include a valve 80 which is also opened when the latches 74, 76 are reconnected.

Prior to reconnecting the upper and lower portions of the test string 12, the accumulator 60 can be charged at the surface with sufficient pressure, so that the lower safety valve 18 can be reopened when the latches 74, 76 are reconnected. In FIG. 3, the accumulator 60 is depicted as a separate element of the test string 12 connected above the upper safety valve 16.

In this manner, the accumulator 60 can be conveniently provided with sufficient volume to displace a large enough quantity of fluid through the line 30 to open the lower safety valve 18 when the latches 74, 76 are reconnected. The accumulator 60 can be interconnected in the test string 12 at the surface after the upper and lower portions of the test string have been disconnected and the upper portion has been retrieved to the surface, or the accumulator can be included in the test string when initially installed in the well.

If the upper safety valve 16 is not used in the system 10 as depicted in the embodiment of FIG. 3, then the line 30 from the lower safety valve 18 could be connected to the accumulator 60 without also being connected to the upper safety valve.

Either of the safety valves 90, 130 described below and depicted in FIGS. 4 & 5 could be substituted for either of the safety valves 16, 18 in the embodiment of the system 10 shown in FIG. 3.

Note that in the system 10 described above, the line 30 does not extend to a surface rig or any other remote location. Thus, the time and expense of installing and pressure testing such long control line umbilicals is eliminated in the system 10. Indeed, the line 30 in the system 10 is isolated from any surface control systems.

As used herein, the term "surface control system" is used to indicate a control system installed at the surface of the earth, at a sea floor or mudline, or on a rig or platform at the surface of a body of water. In conventional safety valve systems, a surface control system is remotely connected to a safety valve via a line, and the surface control system is thereby used to remotely supply pressure to the line and release pressure from the line to operate the safety valve.

Another advantage of the system 10 is that, in certain embodiments, it is not necessary to use highly pressurized nitrogen chambers. However, in some embodiments of the system 10 it may be advantageous to include the accumulator 60 or other chamber containing pressurized gas. Thus, the system 10 provides flexibility in determining whether or not in a particular situation a pressurized gas chamber should be used.

Figure 4:
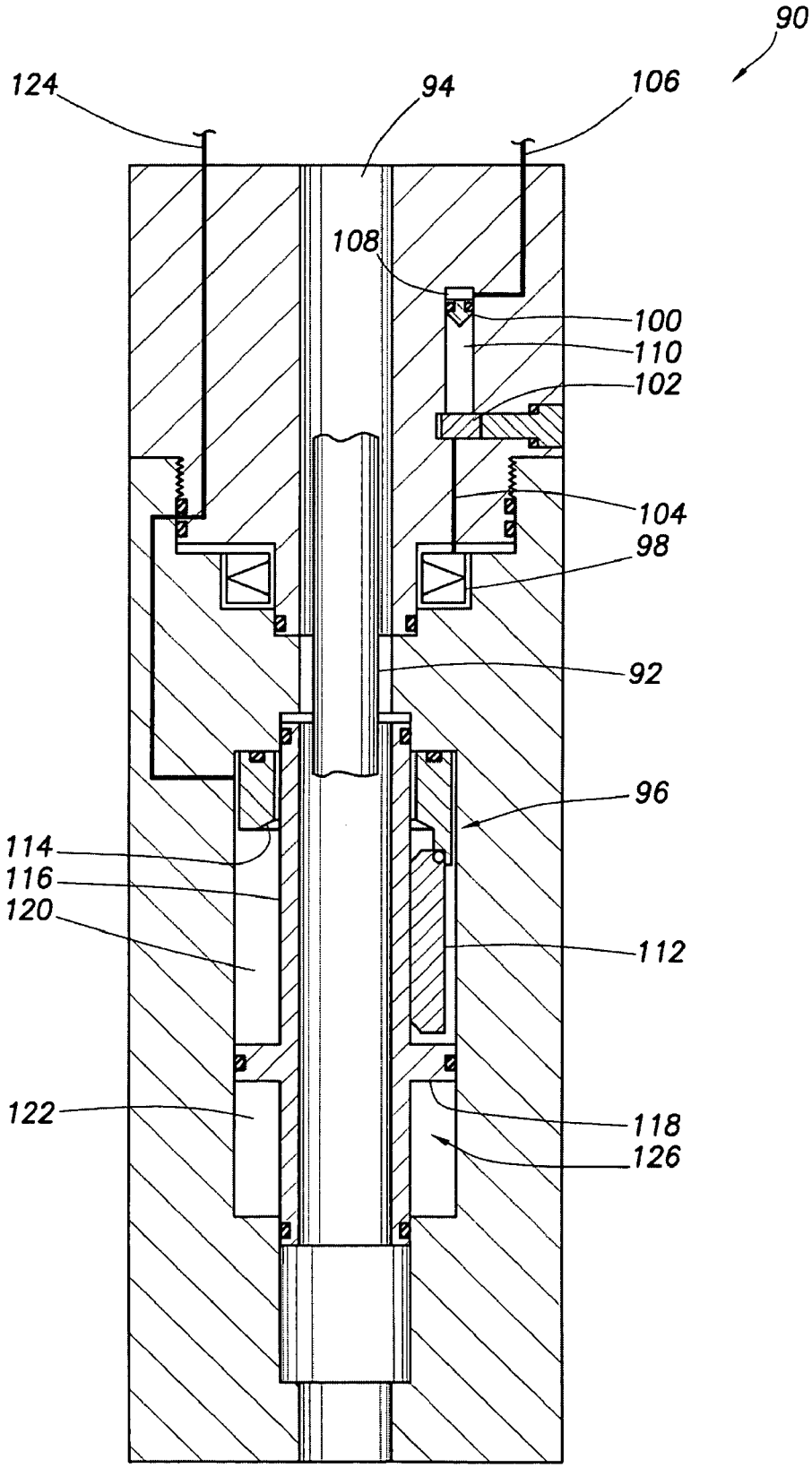
FIG. 4 is a schematic cross-sectional view of another safety valve usable in the system of FIG. 1.

Referring additionally now to FIG. 4, another safety valve 90 which may be used in the system 10 is representatively illustrated. The safety valve 90 could be used in place of either of the upper and lower safety valves 16, 18. Of course, the safety valve 90 could be used in systems other than the system 10, without departing from the principles of the invention.

The ball closure mechanisms 32 of the safety valves 16, 18 described above are preferably designed so that an obstruction (such as a wireline, slickline, coiled tubing, etc.) in the passage 34 will be severed by the closure mechanism when the safety valve is closed. However, it may be desired to separate the functions of severing an obstruction and sealing against flow through the passage 34, so that these functions can be performed independently. The safety valve 90 accomplishes this objective, as well as other objectives of the invention.

As depicted in FIG. 4, an obstruction 92 is positioned in an internal flow passage 94 formed through the safety valve 90. The obstruction 92 will prevent a conventional flapper closure mechanism 96 from closing if the obstruction is not removed from within the closure mechanism.

To remove the obstruction 92, the safety valve 90 includes an explosive cutting device 98 in the form of a circular shaped charge. Similar conventional explosive cutters are used to cut through damaged casing or to retrieve upper portions of stuck drill pipe, etc. In the safety valve 90, the explosive cutting device 98 is directed inward to cut through the obstruction 92 positioned within the cutting device.

It will be appreciated that other types of cutting devices could be used in place of the cutting device 98. For example, a fast-acting chemical, mechanical or other type of cutter could be used.

To detonate the cutting device 98, a firing pin 100 is driven to impact a detonator or initiator 102. A detonating cord 104 extends between the initiator 102 and the cutting device 98. Thus, when the firing pin 100 impacts the initiator 102, the initiator detonates and the cord 104 transfers the detonation to the cutting device 98, which detonates and severs the obstruction 92 in the passage 94.

To drive the firing pin 100 to impact the initiator 102, a line 106 is connected to a chamber 108 above the firing pin. A chamber 110 below the firing pin 100 contains a relatively low pressure (such as atmospheric pressure).

The chamber 108 also initially contains a relatively low pressure. However, when the line 106 is severed or otherwise opened in the well, hydrostatic pressure is allowed to enter the chamber 108 and drive the firing pin 100 downward to impact the initiator 102.

In practice, the line 106 would be positioned within the shear rams 24, similar to the manner in which the line 30 is positioned within the shear rams in the system 10. Thus, the line 106 could extend external to the shear joint 20 and internal to the ramlock 22 as described above.

When the shear rams 24 are operated to sever the test string 12, the line 106 is also severed, thereby causing the obstruction 92 to be severed. Since tension would typically be present in the obstruction 92, this severing of the obstruction will also cause the obstruction to be removed from within the closure mechanism 96.

In the embodiment depicted in FIG. 4, the closure mechanism 96 includes a flapper 112 which is pivotably mounted relative to a seat 114. A spring (not shown) biases the flapper 112 to pivot upwardly toward the seat 114 to seal off the passage 94.

An actuator 126 for the closure mechanism 96 includes a tubular mandrel 116. An upper portion of the mandrel 116 prevents the flapper 112 from pivoting upward, thereby maintaining the closure mechanism 96 in an open configuration.

A piston 118 on the mandrel 116 separates two chambers 120, 122. Initially, when the safety valve 90 is installed in the well, each of the chambers 120, 122 contains a relatively low pressure, such as atmospheric pressure, and the piston 118 is balanced.

A line 124 is connected to the upper chamber 120. The line 124 is severed when the shear rams 24 are operated, thereby permitting hydrostatic pressure to enter the upper chamber 120. This causes a pressure differential across the piston 118, biasing the mandrel 116 to displace downward, and permitting the flapper 112 to pivot upward and seal against the seat 114, thereby preventing flow through the passage 94.

In practice, the line 124 would be positioned within the shear rams 24, similar to the manner in which the line 30 is positioned within the shear rams in the system 10, and similar to the manner in which the line 106 is positioned. Thus, the line 124 could extend external to the shear joint 20 and internal to the ramlock 22 as described above.

If multiple safety valves 90 are used, then the line 106 could be connected between the chambers 108 in the safety valves, and the line 124 could be connected between the chambers 120 in the safety valves. In this manner, the obstruction 92 could be severed in each of the safety valves 90 when the line 106 is severed, and the closure mechanism 96 could be closed in each of the safety valves when the line 124 is severed.

However, it may be preferable to sever the obstruction 92 in only one of the safety valves 90 (to prevent a severed portion of the obstruction from becoming lodged in one of the closure mechanisms 96), so the cutting device 98 may only be used in one safety valve. If only one cutting device 98 is used, then a distal end of the line 106 could be closed off. If only one safety valve 90 is used, then distal ends of both of the lines 106, 124 could be closed off.

Figure 5:
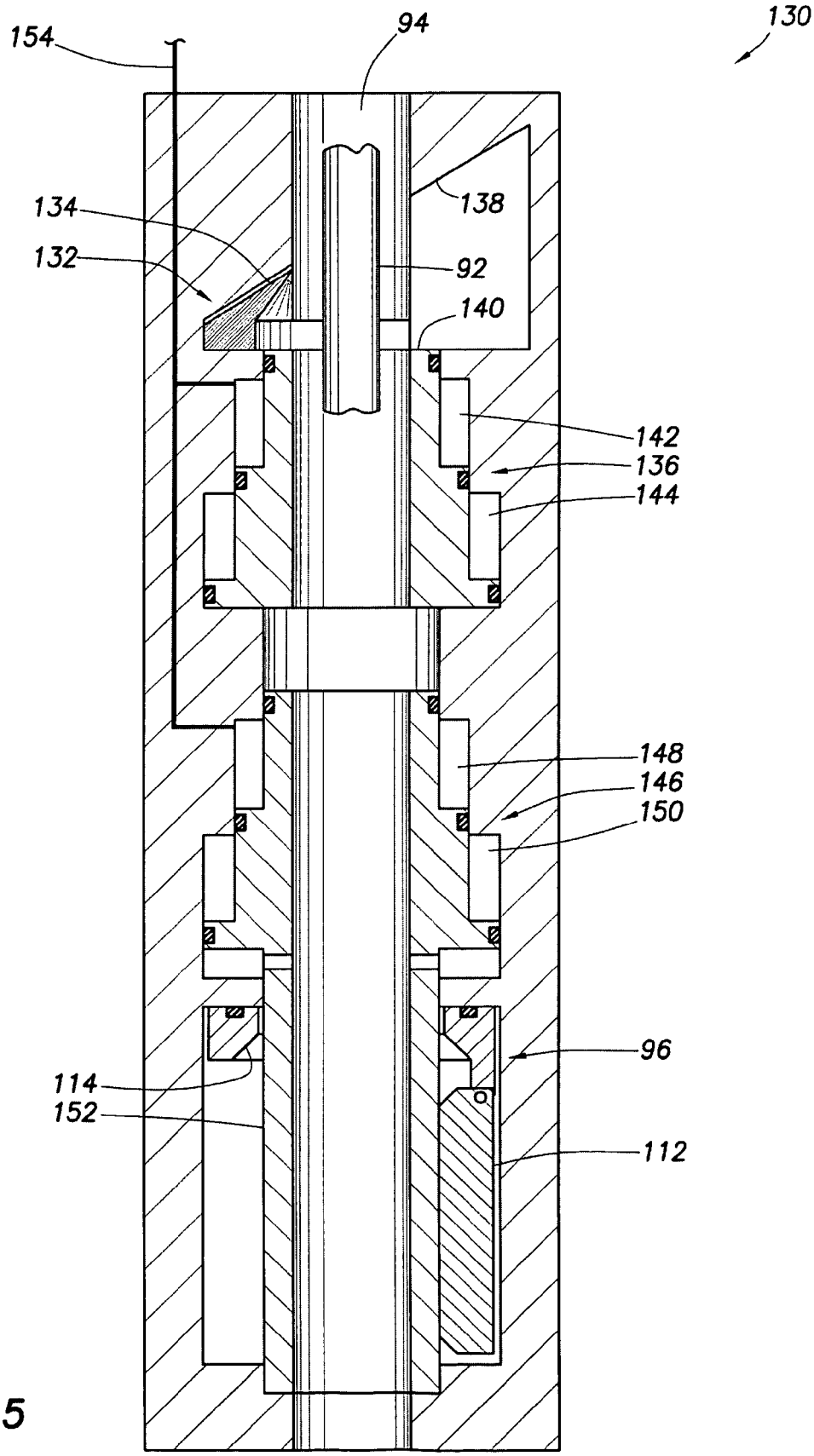
FIG. 5 is a schematic cross-sectional view of yet another safety valve usable in the system of FIG. 1.

Referring additionally now to FIG. 5, another safety valve 130 which may be used in the system 10 is representatively illustrated. The safety valve 130 could be used in place of either of the upper and lower safety valves 16, 18. Of course, the safety valve 130 could be used in systems other than the system 10, without departing from the principles of the invention.

The safety valve 130 is similar in some respects to the safety valve 90 described above. The safety valve 130 is used to sever the obstruction 92 in the passage 94 in order to remove the obstruction from within the flapper closure mechanism 96. In addition, the obstruction severing and passage sealing functions of the safety valve 130 are substantially independent of each other.

However, instead of the explosive cutting device 98, the safety valve 130 includes a mechanical cutting device 132. The cutting device 132 includes a blade 134, an actuator 136 and an inclined ramp 138. To sever the obstruction 92, a tubular mandrel 140 of the actuator 136 is displaced upward, thereby displacing the blade 134 along the ramp 138, causing the blade to displace laterally across the passage 94 and cut through the obstruction 92.

The actuator 136 includes two chambers 142, 144. The lower chamber 144 preferably contains a relatively low pressure, such as atmospheric pressure. It will be readily appreciated by those skilled in the art that when the safety valve 130 is installed in the well hydrostatic pressure acting on the mandrel 140 will cause the mandrel to be biased upwardly due to a differential between the hydrostatic pressure and the relatively low pressure in the chamber 144.

Upward displacement of the mandrel 140 is prevented by fluid (such as a relatively incompressible liquid) contained in the upper chamber 142. Release of this fluid from the chamber 142 will permit the mandrel 140 to displace upward, thereby displacing the blade 134 to cut through the obstruction 92.

An actuator 146 for the closure mechanism 96 includes a similar set of chambers 148, 150 and a mandrel 152. Relatively low pressure is contained in the lower chamber 150. When the safety valve 130 is installed in the well, the mandrel 152 will be biased upwardly due to a pressure differential across the mandrel between hydrostatic pressure in the passage 94 and relatively low pressure in the chamber 150. A fluid (such as a relatively incompressible liquid) is contained in the upper chamber 148 to prevent the mandrel 152 from displacing upward until the fluid in the upper chamber is released.

A lower portion of the mandrel 152 prevents the flapper 112 from pivoting upward toward the seat 114. However, when the mandrel 152 displaces upward, the flapper 112 will be permitted to pivot upward to seal against the seat 114 and prevent flow through the passage 94.

A line 154 is connected to each of the chambers 142, 148. It will be readily appreciated that when hydrostatic pressure is applied to the passage 94 upon installation of the safety valve 130 in the well, pressure in the chambers 142, 148 and in the line 154 will be greater than hydrostatic, due to the differential pressure applied to the mandrels 140, 152.

If the line 154 is severed or otherwise opened in the well, the fluid will be allowed to escape from the line and the chambers 142, 148, and the mandrels 140, 152 will be permitted to displace upwardly. This will result in the obstruction 92 being severed and the closure mechanism 96 being closed.

In practice, the line 154 would be positioned within the shear rams 24, similar to the manner in which the line 30 is positioned within the shear rams in the system 10. Thus, the line 154 could extend external to the shear joint 20 and internal to the ramlock 22 as described above.

If multiple safety valves 130 are used, then the line 154 could be connected between the chambers 142, 148 in the safety valves. In this manner, the obstruction 92 could be severed and the closure mechanism 96 could be closed in each of the safety valves 130 when the line 154 is severed.

However, it may be preferable to sever the obstruction 92 in only one of the safety valves 130 (to prevent a severed portion of the obstruction from becoming lodged in one of the closure mechanisms 96), so the cutting device 132 may only be used in one safety valve. If only one safety valve 130 is used, then a distal end of the line 154 could be closed off.

The line 154 could be connected to an accumulator (such as the accumulator 60 described above, either internal to or external to the safety valve 130). The accumulator 60 could maintain pressure in the chambers 142, 148 regardless of thermal expansion/contraction of the chambers, line 154 and fluid therein.

Note that, similar to the safety valves 16, 18 described above, neither of the safety valves 90, 130 requires a line to extend to a surface control system, and neither of the safety valves 90, 130 requires that pressure be remotely applied to the safety valve to maintain it in an open configuration during installation. In certain preferred embodiments, the safety valves 90, 130 also do not require use of highly pressurized gas chambers.

Although the safety valves 16, 18 are described above as using the ball closure mechanism 32 and the safety valves 90, 130 are described as using the flapper closure mechanism 96, any closure mechanism (including other types of closure mechanisms) may be used in any of these safety valves. Although the safety valves 16, 18 are described as using the ball closure mechanism 32 to sever the obstruction 92, the safety valve 90 is described as using the explosive cutting device 98, and the safety valve 130 is described as using the mechanical cutting device 132, any cutting device (including other types of cutting devices) may be used in any of these safety valves. Furthermore, any of the safety valves 16, 18, 90, 130 described above may use any of the actuators 38, 126, 136, 146, or any other types of actuators.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A safety valve system for use in a subterranean well, comprising:

at least a first safety valve having an actuator; and a line connected to the actuator, the line extending through a device operative to open the line, the first safety valve being operable by opening the line, and the line being free of any fluid communication with a surface control system.

2. The system of claim 1, wherein the first safety valve includes a cutting device, and wherein the cutting device is operable by opening the line in the well.

3. The system of claim 1, wherein a biasing force in the actuator is operative to close the first safety valve in response to opening of the line, the biasing force being produced at least in part by hydrostatic pressure in the well.

4. The system of claim 1, wherein fluid in the line prevents the first safety valve from closing until the line is opened.

5. The system of claim 1, wherein fluid in the line is pressurized above hydrostatic pressure by a biasing force produced in the actuator.

6. The system of claim 1, further comprising a second safety valve and a latch assembly operable to disconnect the first and second safety valves from each other in the well, the latching assembly further being operable to disconnect first and second portions of the line from each other in the well.

7. The system of claim 6, wherein the latch assembly is further operable to reconnect the first and second safety valves to each other in the well, and to reconnect the first and second portions of the line to each other in the well.

* * * * *

UNITED STATES PATENT AND TRADEMARK OFFICE

CERTIFICATE OF CORRECTION

PATENT NO. : 7,624,792 B2
APPLICATION NO. : 11/253766
DATED : December 1, 2009
INVENTOR(S) : Wright et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 244 days.

Signed and Sealed this

Twenty-sixth Day of October, 2010

David J. Kappos

David J. Kappos
*Director of the United States Patent and Trademark Office*